US007878617B2

(12) United States Patent
Mizes et al.

(10) Patent No.: US 7,878,617 B2
(45) Date of Patent: Feb. 1, 2011

(54) REGISTRATION SYSTEM FOR A WEB PRINTER

(75) Inventors: Howard A Mizes, Pittsford, NY (US); Yongsoon Eun, Webster, NY (US); Songkuk Kim, Yorktown Heights, NY (US)

(73) Assignee: Xerox Corporation, Norwalk, CT (US)

( * ) Notice: Subject to any disclaimer, the term of this patent is extended or adjusted under 35 U.S.C. 154(b) by 244 days.

(21) Appl. No.: 12/107,798

(22) Filed: Apr. 23, 2008

(65) Prior Publication Data

US 2009/0265950 A1 Oct. 29, 2009

(51) Int. Cl.
*B41J 29/393* (2006.01)

(52) U.S. Cl. ..... 347/19; 347/14; 347/16

(58) Field of Classification Search ..... None
See application file for complete search history.

(56) References Cited

U.S. PATENT DOCUMENTS 6,118,132 A * 9/2000 Tullis ..... 250/559.39
2002/0029672 A1 3/2002 Raney et al.
2002/0084648 A1* 7/2002 Pierce et al. ..... 283/72
2004/0201669 A1 10/2004 Guha et al.
2005/0028701 A1 2/2005 Scheffer et al.
2005/0123335 A1 6/2005 Heiles et al.
2005/0125180 A1 6/2005 Miller et al.
2006/0114282 A1 6/2006 Mizes et al.
2006/0114283 A1 6/2006 Mizes et al.

* cited by examiner

*Primary Examiner*—Matthew Luu
*Assistant Examiner*—Justin Seo
(74) *Attorney, Agent, or Firm*—Maginot, Moore & Beck LLP

(57) ABSTRACT

An apparatus prints on a continuous web moving in a process direction. A fiducial marker prints on a portion of the web a repeating pattern of fiducial marks at a predetermined spacing along the process direction. At least two printing stations are operatively disposed downstream of the fiducial marker, each printing station including a printhead for placing marking material suitable for a partial image on the web. A photosensor reads a fiducial mark on the web moving relative to the printing station.

16 Claims, 3 Drawing Sheets

REGISTRATION SYSTEM FOR A WEB PRINTER

TECHNICAL FIELD

The present disclosure relates to printing color images on a continuous web.

BACKGROUND

Large-scale printing apparatus, in which images are printed on a continuous web of substrate that is subsequently cut into pages, are well known. When printing color images, it is typical to provide multiple imaging stations along the web path, each station laying down a partial image of a primary color. The primary color images are superimposed to form a full-color image. Of course, in such a situation, precise registration of the different partial images is of concern.

The present disclosure relates to a control system for operating a web-based full-color printing apparatus.

SUMMARY

According to one aspect, there is provided an apparatus for printing an image including partial images on a substantially continuous web moving in a process direction. A fiducial marker, for printing on a portion of the web a repeating pattern of fiducial marks, the repeating pattern comprising a set of unique marks, the fiducial marks being created at a predetermined spacing along the process direction. At least two printing stations are operatively disposed downstream of the fiducial marker, each printing station including a printhead for placing marking material suitable for a partial image on the web, and a photosensor for reading a fiducial mark on the web moving relative to the printing station

DETAILED DESCRIPTION

Figure 1:
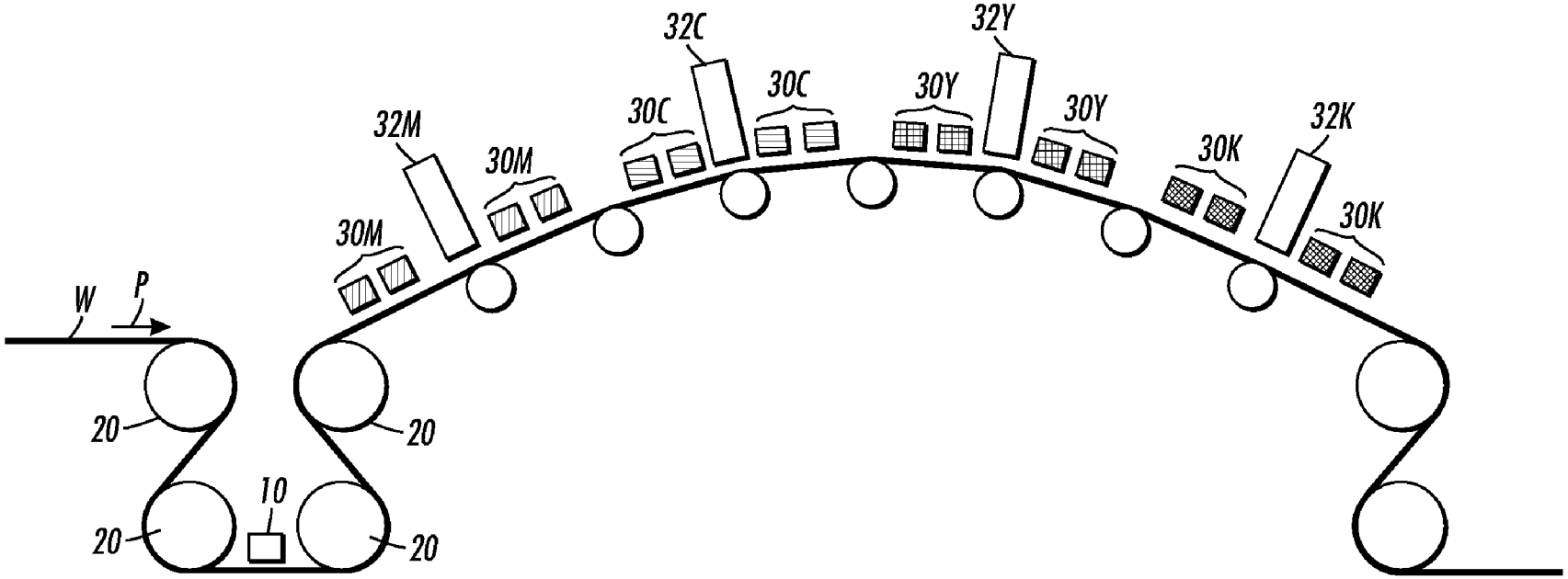
FIG. 1 is a simplified elevational view of an ink-jet printer for printing color images on a continuous web.

FIG. 1 is a simplified elevational view of an ink-jet printer for printing color images on a continuous web. (One possible general configuration of such a printer is shown in U.S. patent application Ser. No. 11/773,549) A web W passes through a process direction P. The web W is typically paper in the printing context, but can be of any material, such as cloth or plastic.

At one point along the process direction P is disposed a fiducial marker 10. In its basic form, fiducial marker 10 is a simple printing device, using, for example, ink-jet technology. As shown, the fiducial marker 10 is disposed among an arrangement of rollers 20, the arrangement of rollers acting to isolate the area of web W under the fiducial marker 10 from sources of positional noise such as vibration, and also to establish a baseline of stretch of web W, as will be explained below.

Further downstream in the process direction P are four print stations, one for each primary color, magenta, cyan, yellow and black (further specialized colors, as well as special-purpose print stations such as for MICR printing, can of course be added in different applications). Each print station includes one or more ink-jet printheads, such as 30M, 30C, 30Y and 30K, arranged to place a primary-color partial image in precisely-defined areas of the moving web W, thus forming a full-color image by the end of the process.

As is well known in all types of color printing, a crucial quality consideration is "registration," the precise placement of partial images on the web forming the combined full-color image. To that end, there is further provided, associated with each print station, a photosensor, such as indicated as 32M, 32C, 32Y, and 32K, placed and adapted to read the fiducial marks placed on web W by fiducial marker 10. In the present embodiment, there a provided a plurality of printheads such as 30M within each station, each printhead placing marking material (such as ink or toner) forming at least a portion of the partial image on the web W; the photosensor such as 32M is placed among the printheads along process direction P.

Figure 2:
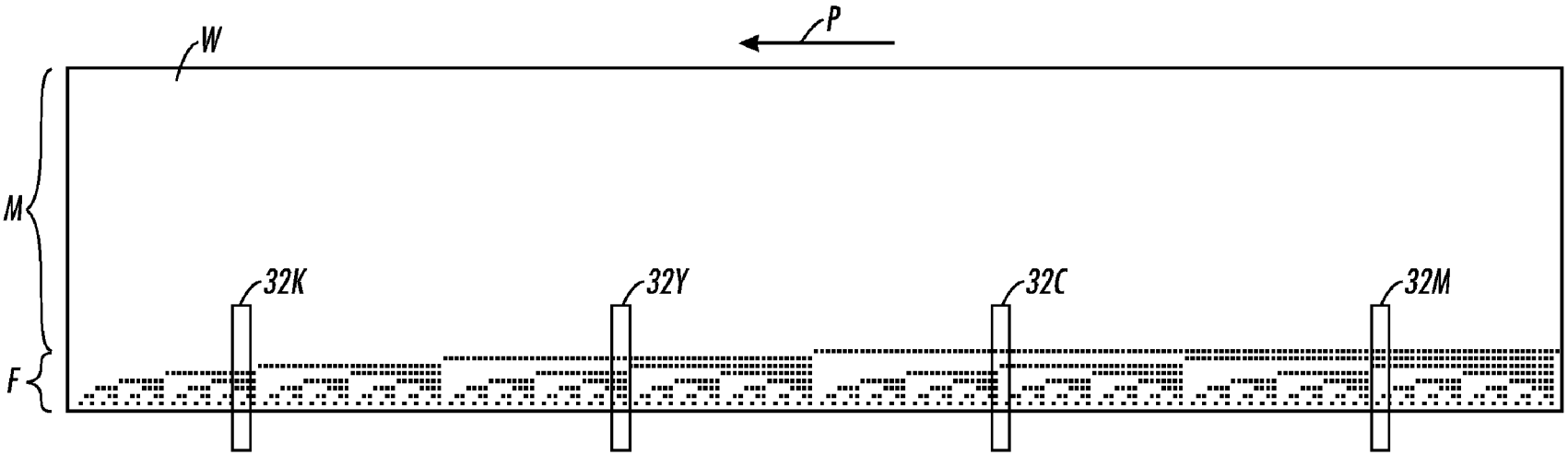
FIG. 2 is a plan view of a portion of a web, showing a type of fiducial mark placed by a fiducial marker.

FIG. 2 is a plan view of a portion of web W, showing a type of fiducial mark placed by fiducial marker 10. In the embodiment, web W defines a main portion M, located to receive customer images, and, along one edge, a fiducial area F. The fiducial marker 10 prints along the fiducial area a repeating pattern along the process direction. The repeating pattern includes an increasing series of binary numbers expressed as dots and spaces for dots, representing 1's and 0's, aligned perpendicular to process direction P. (As used herein, the term "dot" should be construed broadly, to include any recognizable mark, including marks that are formed with colorants invisible to the human eye, and/or detected by non-optical means, such as magnetic fields.) As shown, each period of the pattern represents the binary numbers from 0 to 255 before repeating; each binary number can thus be considered "unique" within a repeating pattern. (Other arrangements for obtaining unique numbers within each pattern could be provided, such as random numbers, Gray code, etc.) The total physical length of each period of repeating pattern can be chosen depending on a given application. Each binary number in the pattern can effectively communicate, to a reading device located along the moving web, the location of the binary number within its period (expressed as a number between 0 and 255); and also, the velocity of the web at a given time, obtained by measuring a time interval between readings of adjacent binary numbers as the web moves.

The fiducial marker 10 prints the fiducial marks at regular time intervals $\Delta t$. The web moves at an average velocity v in the marker region. Therefore, the spacing between the fiducial marks will be $v\Delta t$ on average. The pattern written by the fiducial marks can be indexed by $N_i$. If a repeating pattern is used, the repeat length is chosen so that it will be obvious which section a detected fiducial mark occurs in. The distance the paper moves between a fiducial mark identified by the index (i.e., binary number) $N_2$ and a fiducial mark identified by the index $N_1$ will on average be $(N_2-N_1)v\Delta t$.

As further can be seen in FIG. 2, the photosensors 32M, 32C, 32Y, and 32K, are disposed along the web W to read the fiducial marks in fiducial area F. In one embodiment, all of the photosensors 32M, 32C, 32Y, and 32K take a "snapshot" of the fiducial mark pattern passing underneath each one, simultaneously. Image processing identifies the fiducial index and thus, a measure of the absolute position of the web. The numerical difference between the fiducial marks identified with these two sensors gives the length of the paper between these two sensors. If the web stretch is the same in the printing zone 32 and the marking zone 10, then the measured length of paper will equal to the distance between the two sensors. If the web is more stretched in the printing zone than in the marking zone, then the numerical difference between the fiducial marks will be smaller than the corresponding difference between the two sensors. If the web is more compressed in the printing zone than in the marking zone, then the numerical difference between the fiducial marks will be greater than the corresponding distance between the two sensors. The change in the measured difference between the fiducial marks is proportional to the paper stretch.

Figure 3:
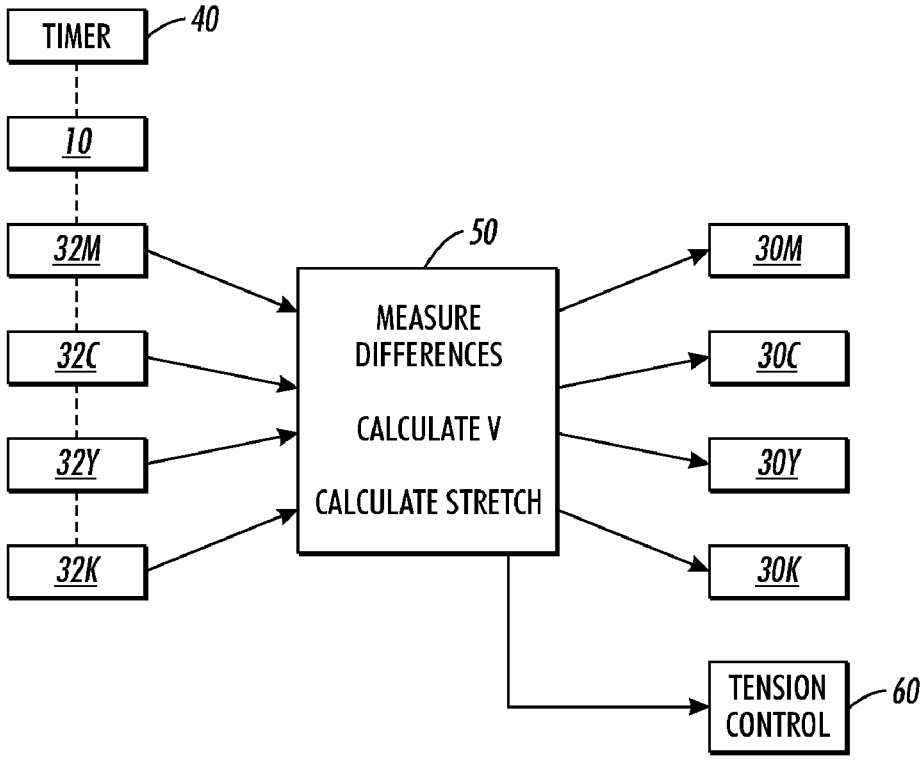
FIG. 3 is a diagram of information flows in a control system governing the apparatus of FIGS. 1 and 2.

FIG. 3 is a diagram of information flows in a control system governing the apparatus of FIGS. 1 and 2. The initial fiducial marker 10 is controlled with the aid of a pattern generator 40. The pattern generator 40 determines which binary numbers are written on the web W and writes them at regular intervals. The photosensors 32M, 32C, 32Y, and 32K are triggered at regular intervals. The trigger generator 45 determines how often snapshots of the fiducial marks are taken. The rate of triggering depends on how often a tension measurement of the web W is desired in the print zone. The triggering does not necessarily have to be simultaneous between the photosensors. If a known time occurs between triggering, the distance of the web motion over this time can be calculated and a tension measurement can still be made. The readings are collected over time and analyzed in a control system 50. The readings, of the various binary number fiducial marks, can be used to determine stretch of the web W. (In some printing contexts, such as when the web W is deliberately or incidentally cooled, the web may exhibit a "negative stretch," or shrinking, which can also be detected.) When the simultaneous snapshots are taken on a periodic basis determined by control system, a velocity V of the web W can also be determined, as well as dynamic anomalies in the readings, i.e., the differences in readings among the photosensors change relative to each other over time, such as caused by gradual stretching of the web W. Changes in readings between specific pairs of photosensors, such as 32Y and 32K, can be detected to isolate local changes in velocity or stretch, as would be caused, for example, by an improperly-operating roller within the apparatus.

Web stretching and shrinking as well as web velocity changes can cause registration errors between the colors. As different types of web anomalies are detected and determined by the system, the output of data and timing instructions to printheads 30M, 30C, 30Y and 30K is modified to overcome the detected anomalies to yield the desired precision of image registration. If the anomalies exceed a certain magnitude or are of a certain detectable type, the drive system 60 causing motion of web W can be finely controlled as well.

Figure 4:
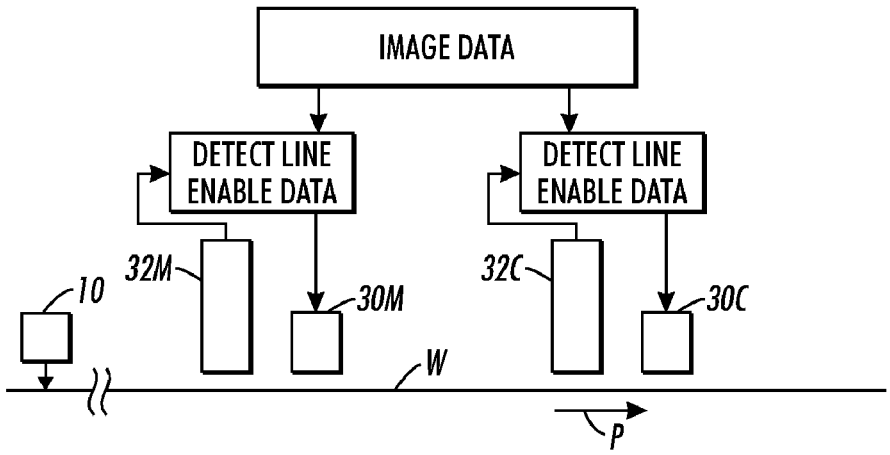
FIG. 4 is a diagram showing an alternative approach to controlling image data in response to detected fiducial data, using much of the basic hardware of FIG. 1.

FIG. 4 is a diagram showing an alternative, "reflex" approach to controlling image data in response to detected fiducial data, using much of the basic hardware of FIG. 1. In this arrangement, each print station, comprising a photosensor such as 32M and printhead such as 30M, acts largely independently of other print stations along process direction P. In this embodiment, the printhead will fire ink at a rate with the current detected web velocity. The photosensor monitors the fiducial marks as they pass under. The index identified by each fiducial will be compared to the index expected at that point in time. If the fiducial is identified before it is expected, the firing of the printhead will be increased slightly until the firing corresponds to the fiducial position. If the fiducial is identified after it is expected, the firing of the printhead will be decreased slightly until the detected fiducial corresponds to the expected fiducial. In another embodiment, a photosensor such as 32M waits for, a fiducial mark consistent with a specific binary number, and then, when that binary number is read, enables the printhead to "fire" its ink in the raster image at a precisely-defined time consistent with the detected binary number. For example, in the course of operation, the image data desired to be placed on the web W in a location aligned with line 175 out of lines 0-255 is loaded into the printhead just before firing; only when the binary number consistent with line 175 is actually detected by photosensor 32M is the printhead "fired," at predetermined fixed time after the detection. The process occurs for every binary number within each repeating pattern, and interpolation can be carried out for data lines that fall between the fiducial marks. An advantage of this system is that each print station operates somewhat independently of the others: each print station "looks at" only a relatively short length of web W, and thus anomalies, such as relating to web stretch, that develop over a long process, are obviated.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An apparatus for printing an image including partial images on a substantially continuous web moving in a process direction, comprising:

a fiducial marker, for printing on a portion of the web a repeating pattern of fiducial marks, the repeating pattern comprising a set of unique marks, the fiducial marks being created at a predetermined spacing along the process direction;

at least two printing stations operatively disposed downstream of the fiducial marker, each printing station including a printhead for placing marking material suitable for a partial image on the web, and a photosensor for reading a fiducial mark on the web moving relative to the printing station; and a control system configured to obtain fiducial mark readings from the photosensors associated with the printing stations and to calculate a stretch of the web with reference to at least two photosensor readings of different fiducial marks that were obtained substantially simultaneously.

2. The apparatus of claim 1, each unique mark being associated with a position along the web.

3. The apparatus of claim 1, each unique mark including a plurality of dots or dot spaces arranged to extend perpendicular to the process direction.

4. The apparatus of claim 1, the control system repeatedly causing the photosensors associated with the printing stations to read fiducial marks substantially simultaneously.

5. The apparatus of claim 1, the control system calculating a velocity of the web based on at least two photosensor readings of different fiducial marks that were obtained substantially simultaneously.

6. The apparatus of claim 1, the control system calculating a local stretch of the web based on at least two photosensor readings of different fiducial marks that were obtained substantially simultaneously.

7. The apparatus of claim 5, the control system influencing operation of at least one printhead, based on at least one of the calculated stretch and the calculated velocity of the web.

8. The apparatus of claim 5, the control system influencing operation of a drive system for the web, based on at least one of the calculated stretch and the calculated velocity of the web.

9. An apparatus for printing an image including partial images on a substantially continuous web moving in a process direction, comprising:

a fiducial marker, for printing on a portion of the web a repeating pattern of fiducial marks, the repeating pattern comprising a set of unique marks, the fiducial marks being created at a predetermined spacing along the process direction;

at least two printing stations operatively disposed downstream of the fiducial marker, each printing station including a printhead for placing marking material suitable for a partial image on the web, and a photosensor for reading a fiducial mark on the web moving relative to the printing station; and a control system configured to obtain fiducial mark readings from the photosensors associated with the printing stations and to calculate a velocity of the web with reference to at least two photosensor readings of different fiducial marks that were obtained substantially simultaneously.

10. The apparatus of claim 9, each unique mark being associated with a position along the web.

11. The apparatus of claim 9, each unique mark including a plurality of dots or dot spaces arranged to extend perpendicular to the process direction.

12. The apparatus of claim 9, the control system repeatedly causing the photosensors associated with the printing stations to read fiducial marks substantially simultaneously.

13. The apparatus of claim 9, the control system calculating a stretch of the web based on at least two photosensor readings of different fiducial marks that were obtained substantially simultaneously.

14. The apparatus of claim 9, the control system calculating a local stretch of the web based on at least two photosensor readings of different fiducial marks that were obtained substantially simultaneously.

15. The apparatus of claim 13, the control system influencing operation of at least one printhead, based on at least one of the calculated stretch and the calculated velocity of the web.

16. The apparatus of claim 13, the control system influencing operation of a drive system for the web, based on at least one of the calculated stretch and the calculated velocity of the web.

* * * * *